United States Patent [19]

Yoshitomi et al.

[11] 3,939,681

[45] Feb. 24, 1976

[54] METHOD OF EXPLOSIVELY EXPANDING TUBES

[75] Inventors: Hirohiko Yoshitomi; Junji Hashimoto; Taro Kodama; Fujiharu Hirose, all of Nobeoka, Japan

[73] Assignee: Asahi Kasei Kogyo Kabushiki Kaisha, Osaka, Japan

[22] Filed: June 17, 1974

[21] Appl. No.: 480,297

[30] Foreign Application Priority Data

| | | |
|---|---|---|
| July 4, 1973 | Japan | 48-74738 |
| July 4, 1973 | Japan | 48-74739 |
| Nov. 16, 1973 | Japan | 48-128156 |

[52] U.S. Cl. ..... 72/56; 29/421 E

[51] Int. Cl.[2] ..... B21D 26/02

[58] Field of Search ..... 72/56; 29/421 E; 228/3; 102/24

[56] References Cited

UNITED STATES PATENTS

| | | | |
|---|---|---|---|
| 3,409,969 | 11/1968 | Simons et al. | 29/421 E |
| 3,426,681 | 2/1969 | Oliver | 102/24 |
| 3,442,105 | 5/1969 | Susnowicz et al. | 29/421 E |
| 3,503,110 | 3/1970 | Berry et al. | 29/421 E |
| 3,672,035 | 6/1972 | Liberman | 29/421 E |
| 3,739,614 | 6/1973 | Cranston | 29/421 E |

*Primary Examiner*—C. W. Lanham
*Assistant Examiner*—Robert M. Rogers
*Attorney, Agent, or Firm*—Cooper, Dunham, Clark, Griffin & Moran

[57] ABSTRACT

This invention provides a method of securing the tube ends of a plurality of explosively expandable metal tubes to a tube plate in which the tubes are inserted utilizing explosive cartridges equipped with a heat sensitive means. The heat sensitive means is in operative proximity to the explosive charges. There are also provided heating means capable of effectively heating the heat sensitive means. Expansion of the tubes located at multiple positions is effected by successively exploding the charges by the application of heat energy to the heat sensitive means.

11 Claims, 6 Drawing Figures

METHOD OF EXPLOSIVELY EXPANDING TUBES

BACKGROUND OF THE INVENTION

1. Field of the Invention

This invention relates to improvements in the explosion-initiating method for fixing tubes on a tube plate by means of explosives.

2. Description of the Prior Art

There is a demand for effecting connection of tubes with a tube plate in a variety of industrial fields. One of the fields is the production of heat exchangers in which a multitude of tubes arranged in parallel are fixed at their ends on a tube plate extending perpendicular to the longitudinal direction of the tube. Coupling areas between the tube ends and the tube plate should be leak resistant to avoid mixing of materials passing through the heat exchanger.

Methods known for connecting a tube with a tube plate include mechanical expansion of the tube by means of a tube expander followed by sealing of the joint between the tube and the tube plate utilizing gas or arc welding. It is difficult to effect sealing without decreasing the maximum strength of the tube, the walls of which are normally quite thin. Moreover, the sealed joint is often so frigile that it will not resist large changes in pressure. Additionally, the formation of the joint by expansion requires precise controls of the shape, size, and finishing of the hole in the tube plate receiving the tube. For best results, the tube expander must be carefully placed on the tube plate and the expansion must be conducted carefully. The construction of the joint portion by expansion requires a considerable period of time because the portion to be joined should be deformed slowly and, to minimize undesirable stress distribution. Welding of the joint portion may be complicated by limited compatibility between the metals in the tube and the tube plate. In some cases, welding causes permanent softening and annealing of the tube. Minute variations in thickness of the tube in the area to be welded will reduce the reliability of the weld, and often result in leakages.

In order to overcome these disadvantages, explosive tube expansion has been adopted. This technique involves fixing of the tube on the tube plate utilizing explosive energy. The explosion is usually initiated by electric ignition. However, in this procedure, as the number of tubes to be expanded increases, the number of the tubes to be expanded is increased the wiring techniques become more and more complicated, and the time required for wiring increases. This reduces the efficiency of the procedure.

SUMMARY OF THE INVENTION

It is an object of the present invention to provide a method for efficiently initiating the explosion that is perfectly free from the aforementioned disadvantages of the prior-art methods. a method is provided for securing the tube ends of a plurality of explosively expandable metallic tubes to a tube plate in which said tubes are inserted, which comprises the steps of:

1. inserting a cartridge containing an explosive charge in each of the metallic tubes to be secured to the tube plate, there being heat sensitive means in operative proximity to each of said explosive charges, each of said heat sensitive means having an end portion projecting beyond the tube in which said cartridge is inserted; and 2. successively igniting said heat sensitive means thereby successively to explode said explosive charges and expand said expandable metallic tubes by applying heat energy to said heat sensitive means through heating means positioned adjacent said projecting end portions to successively transfer heat energy to said heat sensitive means.

DESCRIPTION OF THE INVENTION

Figure 1:
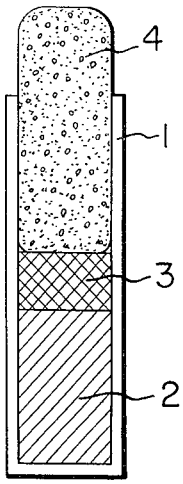
FIG. 1 of the accompanying drawing is a section view of an illustrative explosive cartridge equipped with a heat sensitive means for explosive tube expansion according to the invention in which the heat sensitive means consists of a porous macromolecular substance.
Figure 2A:
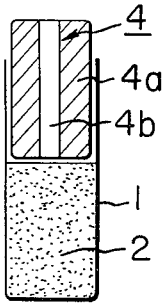
FIGS. 2(*a*) and 2(*b*) illustrate the charging sequence of the explosive device.
Figure 2B:
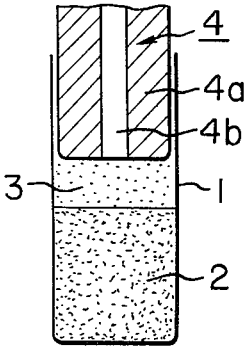

FIGS. 1 and 2 respectively represent a section view illustrating the structure of an explosive device suitable for use in the present invention. The device shown in FIG. 1 consists of a tube body 1 made of metal, synthetic resin, paper or the like which is filled with a principal explosive charge 2 and if necessary, is charged with an initiator 3. Heat sensitive means 4 are also provided. In the device shown in FIG. 2(*a*) the tube body 1 is charged with the explosive 2 (the initiator 3 and the explosive 2 in FIG. 2*b*), on which a core agent 4*b* having a fuse (with the coating 4*a*) as a heat sensitive means. The heat sensitive means 4 is arranged in such a manner that it will be ignited by heat energy from a heating means to induce explosion of the explosive 2 and the initiator 3.

A variety of sensitive means are suitable for use in the invention. Typical examples include the safety fuses as described above, delay fuse or similar structures. A substance readily fired with gas flame may be applied to the outer end portion of the fuse in order to improve the firing. The heat sensitive means may also be an elastic porous macromolecular substance in which an oxidizing agent such as potassium nitrate or potassium chlorate and/or an inflammable material such as methanol, ethanol, gasoline or benzene or a powders such as black powders or smokeless powders are dispersed or adsorbed to improve combustion propagation. Porous macromolecular substances suitable for use in the invention include phenol-, urea-, and melamine formaldehyde resins, alkyd redins, poly-urethanes, polyvinyl formals, polyvinyl chloride, polystyrene, polyethylene, cellulose ester derivatives, cellulose ether derivatives, viscose and similar soft resins, natural fibers such as cellulose, sponges of natural and synthetic rubbers, and the like. The porous macromolecular substance may be in any form provided that the heat from the heating means is satisfactorily received and transmitted. Although form of said heat sensitive means is not limited to the means shown as 4 in FIG. 1, a portion thereof normally be exposed outside the explosive cartridge to improve the efficiency of the invention.

Heating means which may be employed in the invention include either solid fuels in the form of sheets, rods or planes, gas or oil burners or electrical heaters.

Figure 3:
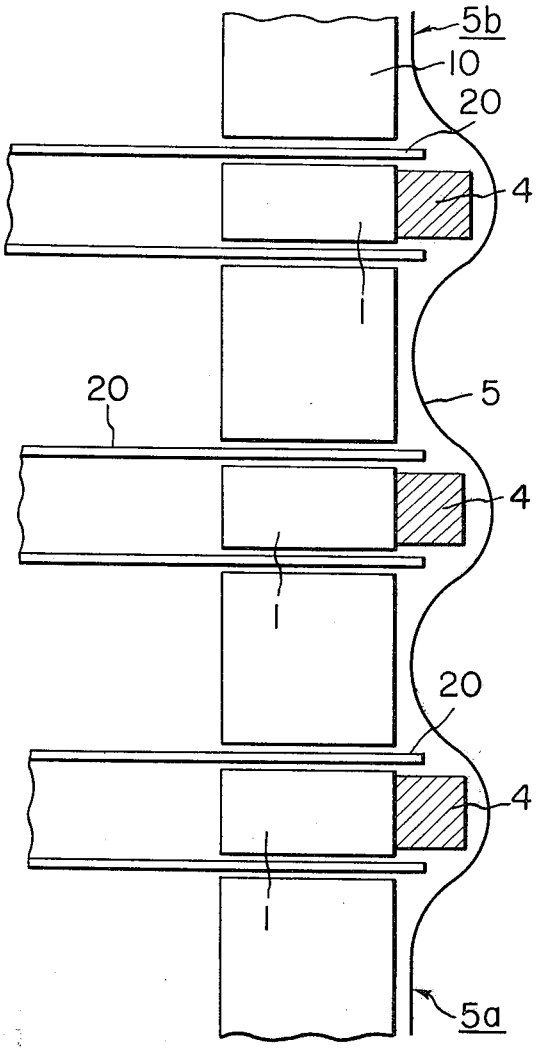
FIG. 3 is a cross section view of an embodiment of the invention.
Figure 4:
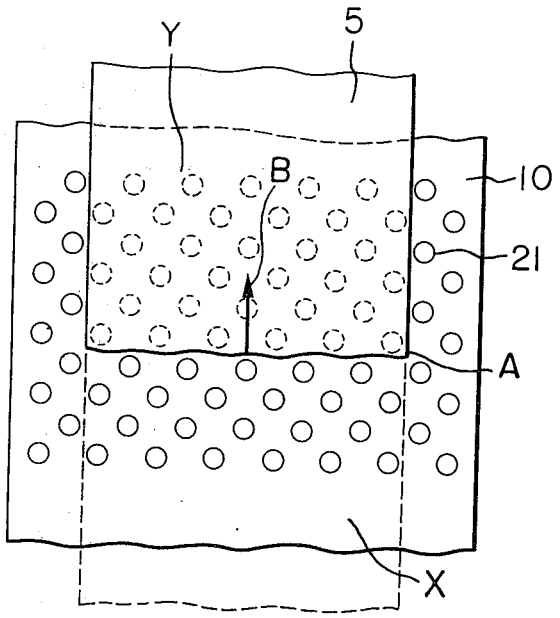
FIG. 4 is a plain view of an embodiment of the invention.

FIGS. 3 and 4 respectively are section and plane views of an illustrative embodiment of the invention. In fixing the tubes 20 on the tube plate 10 in FIG. 3 by tube expansion, the detonator or explosive cartridge 1 charged with the heat sensitive means 4 which is used as the explosive means for tube expansion is inserted in each of the tubes and then a combustive sheet 5 is placed over the heat sensitive means 4 in as close proximity as possible. One end *5a* of said sheet is ignited. When the combustion of the slowly burning combustible sheet 5a comes close to the heat sensitive means 4 of the explosive shell 4 said heat sensitive means will be fired thereby exploding the detonator or the explosive cartridge 1. As the combustible sheet is slowly burned from one end 5a toward the other end 5b, a plurality of tube expansion explosions take place.

In FIG. 4, the tubes 21 to be expanded are arranged on the tube plate 10 and each of the tubes is fitted with a detonator or explosive cartridge equipped with heat sensitive means. The combustible sheet 5 is placed over the tubes and one end is fired. The sheet is slowly burned in the direction of the arrow B and explosions of the detonators or explosive cartridges at the position X through which the surface of combustion wave A is passed are consecutively initiated. The area shown by Y is one where the combustive sheet has not yet been burnt with the detonators or explosive cartridges unexploded.

The combustive sheet may be, for example a combustible film made of cloth, paper, cellulose, synthetic resin or the like, which may be impregnated an oxidizing agent such as potassium nitrate, potassium chlorate or the like in order to ensure the propagation of combustion. Solid fuel in the form of rod or sheet provides the same effect as the combustible sheet. The heat generated from combustion of the fuel can be utilized efficiently.

Figure 5:
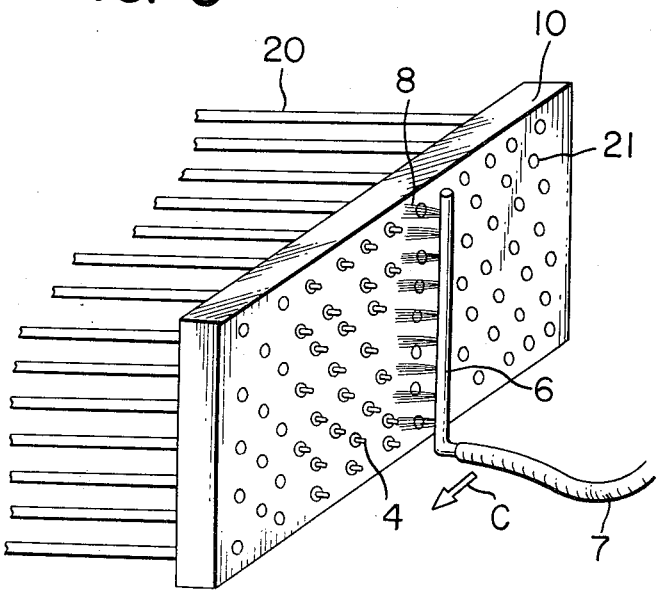
FIG. 5 is a perspective view of an embodiment of the invention.

FIG. 5 is a perspective view representing another embodiment of the invention, in which a rod-form burner 6 is employed as the heating means. A number of holes are provided for the gas jet at regular intervals in the burner to produce a gas flame and ignite the adjacent explosive means. If the gas burner 6 is equipped with means for movement so that it is moved prior to the time of explosion, damage to the gas burner can be prevented. It is possible further to ensure the prevention of damage of the heating means by prolonging said time-lag between heating and explosion by employing a delay fuse as the heat sensitive means. If the gas burner 6 is constructed in such a manner that it is moved at a selected velocity preferably automatically and remotely, the flame 8 of the gas burner 6 will be successively contacted with the core agent of the heat sensitive means. The transfer of the burner 6 in the direction of the arrow C will successively initiate a plurality of explosions. The fuel used for the burner 6 is supplied by means of the gas conduit 7, which may be any combustible alkane gas such as methane, propane, acetylene, city gas, hydrogen, oil mist or the like. Single or combined electric heaters in the form of rods or planes may also be employed to produce the same effect as burner 6.

It is a fundamental idea of the invention to cause ignition of the heat sensitive means by heat energy from the high-temperature heat radiating portion of a heating means such as a flame. Since electrical ignition is not used, the deficiencies of the prior art are avoided.

Furthermore, unlike the case where ignited there are simultaneous explosions, the utilization of consecutive explosions materially reduces the sound level and explosive force so that sound and energy absorbing measures can easily be taken.

The following non-limiting examples are given by way of illustration.

EXAMPLE 1.

Explosively expandable carbon steel tubes for heat exchangers each 2.8 mm in thickness and 45 mm in inner diameter were placed in a tube plate 60 mm in thickness by means of polyethylene explosive cartridges each containing 1.5 g. of an explosive. Each cartridge was equipped in the upper space portion with polyvinyl formal of a specific density of 0.30 impregnated with potassium chlorate as the heat sensitive means and inserted into the tube as shown in FIG. 3. A combustible sheet made of a cloth impregnated with potassium nitrate was located in contact with or close to the explosive cartridges. The combustible sheet was ignited at the lower end and slowly burned to ignite the heat sensitive means and fire the explosive cartridges thereby fixing the tubes in the tube plate.

EXAMPLE 2.

A stainless steel plate 62 mm in thickness was machined to form 30 holes each 19.2 mm in diameter, into each of which was fit a stainless steel tube 19.0 mm in outer diameter. A plastic cartridge filled with 0.3 g. of PETN and 0.2 g. of DDNP was inserted in each tube. Each explosive cartridge was then charged with a safety fuse 50 mm in length. As shown in FIG. 3, a combustible sheet made of paper towel impregnated with potassium nitrate was placed in contact with or close to the end plane of the fuses. The combustible sheet was ignited at the lower end and slowly fired to fire successively the fuses and then the explosive cartridges thereby fixing the tubes on the tube plate.

EXAMPLE 3.

A carbon steel plate 69 mm in thickness was machined to form 81 holes each 25.6 mm in diameter, into each of which was fit a carbon steel tube 25.4 mm in outer diameter. An explosive cartridge made of plastic case was filled with 5.0 g. of PETN and 0.4 g. of DDNP and inserted in each of said steel tubes. Each explosive cartridge was charged with a safety fuse 50 mm in length. Propane fuel gas was introduced under a pressure of 0.5 $Kg/cm^2$ into a stainless steel tube 50 cm in length and 30 mm in diameter with gas jet holes set at an intervals of 10 mm. The gas was burned to fire the safety fuses with the flame for successive initiations of the explosion of the cartridges. The tubes fixed on the tube plate were resistant to a hydraulic pressure of 75 $Kg/cm^2$.

EXAMPLE 4.

A carbon steel plate 69 mm in thcikness was machined to form 196 holes each 25.6 mm in diameter, into each of which was fit a carbon steel tube 25.4 mm in outer diameter. Into each steel tubes was inserted an explosive cartridge made of a plastic case filled under pressure with 5.0 g. of PETN and 0.4 g. of DDNP. Each explosive cartridge was charged with a delay fuse 35 mm in length on the outer cut surface of which was applied 0.1 g. of nitrocellulose. Acetylene-oxygen gas mixture used as the fuel gas was burned in a rod burner made of stainless steel tube with gas jet holes set at intervals of 5 mm. The nitrocellulose delay fuses were successively fired with the flame of the burner to explode the cartridges. Ignition of all of the cartridges required 20 seconds. The tubes fixed in the tube plate were resistant to a hydraulic pressure of 95 $Kg/cm^2$.

We claim:

1. A method of securing the tube ends of a plurality of explosively expandable metallic tubes to a tube plate in which said tubes are inserted, which comprises the steps of:

1. inserting a cartridge containing an explosive charge in each of the metallic tubes to be secured to the tube plate, there being heat sensitive means in operative proximity to each of said explosive charges, each of said heat sensitive means having an end portion projecting beyond the tube in which said cartridge is inserted; and
2. successively igniting said heat sensitive means thereby successively to explode said explosive charges and expand said expandable metallic tubes by applying heat energy to said heat sensitive means through heating means positioned adjacent said projectend portions to successively transfer heat energy to said heat sensitive means.

2. A method as in claim 1 wherein said heating means are selected from the group consisting of combustible sheets, gas burners, electric heaters and solid fuel.

3. A method according to claim 1 wherein each of said cartridge is made of metal, paper or synthetic resin.

4. A method according to claim 1 wherein each of said heat sensitive means comprises an elastic, porous, macromolecular substance impregnated with an oxidizer or combustible agent.

5. A method according to claim 1 wherein each of said heat sensitive means is a fuse.

6. A method according to claim 5 wherein each of said heat sensitive fuses is a time fuse.

7. A method according to claim 1 wherein said heating means is cloth, paper, cellulose or synthetic resin.

8. A method according to claim 7 wherein said cloth, paper, cellulose or synthetic resin is impregnated with an oxidizer.

9. A method according to claim 1 wherein said heating means is a gas burner having a plurality of aligned jets or a cross-sectionally linear jet.

10. A method according to claim 1 wherein said heating means is an electric heater having at least one rod-type or plate-type heat-radiating part.

11. A method according to claim 2 wherein said solid fuel is rod or plate-shaped.

* * * * *

UNITED STATES PATENT OFFICE

CERTIFICATE OF CORRECTION

PATENT NO. : 3,939,681

DATED : February 24, 1976

INVENTOR(S) : Hirohiko Yoshitomi et al.

It is certified that error appears in the above-identified patent and that said Letters Patent are hereby corrected as shown below:

Column 5, line 26, change "projectend" to read

-- projecting --.

Signed and Sealed this

Sixth Day of July 1976

[SEAL]

*Attest:*

RUTH C. MASON
*Attesting Officer*

C. MARSHALL DANN
*Commissioner of Patents and Trademarks*